US006572943B2

(12) United States Patent
Shaffer

(10) Patent No.: US 6,572,943 B2
(45) Date of Patent: Jun. 3, 2003

(54) DEVICE AND A METHOD FOR HANGING AN OBJECT AS WELL AS AN OBJECT INCORPORATING SUCH A HANGING DEVICE

(76) Inventor: Andy Shaffer, 7807 Hamilton Ave., Burr Ridge, IL (US) 60521

( * ) Notice: Subject to any disclaimer, the term of this patent is extended or adjusted under 35 U.S.C. 154(b) by 0 days.

(21) Appl. No.: 09/745,615

(22) Filed: Dec. 22, 2000

(65) Prior Publication Data

US 2002/0081409 A1 Jun. 27, 2002

(51) Int. Cl.[7] ..... B32B 9/00

(52) U.S. Cl. ..... 428/40.1; 248/467; 248/610; 248/683; 428/40.9; 428/41.8; 428/41.9; 428/42.1; 428/42.2; 428/43; 428/131; 428/138

(58) Field of Search ..... 428/40.1, 40.9, 428/41.8, 41.9, 42.1, 42.2, 43, 131, 138; 248/683, 610, 467

(56) References Cited

U.S. PATENT DOCUMENTS 4,832,301 A * 5/1989 Hiramoto ..... 248/467

* cited by examiner

*Primary Examiner*—Nasser Ahmad
(74) *Attorney, Agent, or Firm*—Patent +TMS, P.C.

(57) ABSTRACT

The present invention generally relates to a device and a method for hanging an object, such as a mirror or frame or other like objects. The present invention further relates to an object for incorporating such a hanging device. More specifically, the present invention provides an apparatus for mounting objects to a surface by adhesively attaching the object to a bracket. An aperture on the bracket may be used to hang the object on a surface, such as a wall.

17 Claims, 2 Drawing Sheets

DEVICE AND A METHOD FOR HANGING AN OBJECT AS WELL AS AN OBJECT INCORPORATING SUCH A HANGING DEVICE

BACKGROUND OF THE INVENTION

The present invention generally relates to a device and a method for hanging an object, such as a mirror, a frame or other like objects. The present invention further relates to an object incorporating such a hanging device. More specifically, the present invention provides an apparatus for mounting objects to a surface by adhesively attaching the object to a bracket. An aperture on the bracket may be used to hang the object on the surface, such as a wall.

It is, of course, generally known to hang mirrors, frames or other objects on a wall or other surface. Some objects that require hanging include a hanging mechanism or device pre-attached to a back side of the object. However, many objects to be hung require the purchase of, for example, a hanging device, such as a hanger, hook, clip, chain, pin and/or putty. Then, the object to be hung must be measured, and the hanging device may be attached to the object using, for example, a screw or other means.

Further, choosing the correct hanging device and then attaching the same is often difficult and time consuming. Moreover, holes are often required to be made in a frame of the object to be hung to insert screws and/or other fasteners to secure the hanging device to the object. In addition, for heavier objects, care must be taken in choosing an adequate hanging device that supports greater weight. Putty or light weight hangers often do not hold a heavier object. Often, however, individuals attempt to hang heavier objects with a hanging device that is not suitable to support the weight. The object may later fall from its hanging position and damage the object.

Still further, using screws to attach a hanging device to a mirror or frame requires patience and care. One must measure the appropriate place to attach the screws. Further, many times an object is hung crooked if the hanging device is not measured and properly placed. In addition, screws require holes to be made in the object to be hung and may damage a frame of the object and/or the object itself.

A need, therefore, exists for a hanging device that is easy to install and that may be used with all types of mirrors or frames or other like objects as well as a method for hanging and an object incorporating such a hanging device.

SUMMARY OF THE INVENTION

The present invention generally relates to a device and a method for hanging an object, such as a mirror or frame or other like objects. The present invention further relates to an object for incorporating such a hanging device.

To this end, in an embodiment, an apparatus for hanging an object is provided. The apparatus has a sheet having a first portion and a second portion. The first portion forms a majority of the sheet and is integrally connected to the second portion. Further, a bend connecting the first portion of the sheet to the second portion of the sheet is provided such that the first portion of the sheet is in a plane offset from the second portion of the sheet. A hole is located in the second portion of the sheet. Still further, a first adhesive having a first side and a second side is provided. The first side is attached to the first portion of the sheet. A layer having a front side and a back side is provided. The front side of the layer is attached to the second side of the first adhesive. Still further, a second adhesive is attached to the back side of the layer. A non-adhesive layer and a silicone layer are removably attached to the second adhesive such that the silicone layer is located between the non-adhesive layer and the second adhesive.

In an embodiment of the present invention, the sheet is constructed of metal.

In an embodiment, the hole is shaped to fit around a protruding element.

In an embodiment, the sheet is rectangular in shape.

In another embodiment of the present invention, a method for hanging an object is provided. The method comprises the steps of: providing a sheet having a first portion in a first plane and a second portion in a second plane wherein the first plane and the second plane are substantially parallel; providing a bend connecting the first portion of the sheet to the second portion of the sheet wherein the bend defines an offset between the first plane and the second plane; providing an adhesive on the first portion; and attaching the first portion to the object.

In an embodiment, the method further comprises the steps of locating a center of the object; locating a center of the sheet; aligning the center of the sheet with the center of the object; and attaching the center of the sheet at the center of the object.

In another embodiment of the present invention, an apparatus mountable to a surface is provided. The apparatus has a back side defining a plane and a bend protruding from the back side. Further, the apparatus has a hanging device associated with the bend wherein the hanging device is in a plane offset a depth from the plane of the back side.

In an embodiment, the hanging device is substantially parallel to the back side.

In an embodiment, the apparatus has a hole in the hanging device.

In an embodiment, the hole is shaped to fit around a protruding element.

In an embodiment, the hanging device is rectangular in shape.

In an embodiment, the bend is rectangular in shape.

In an embodiment, the hanging device is constructed of metal.

It is, therefore, an advantage of the present invention to provide a hanging device, a method for hanging an object, and an object incorporating the hanging device that is simple to use.

Another advantage of the present invention is to provide a hanging device, a method for hanging an object, and an object incorporating the hanging device that minimizes damage to the object to be hung.

Another advantage of the present invention is to provide a hanging device, a method for hanging an object, and an object incorporating the hanging device that can support several hundred pounds.

Another advantage of the present invention is to provide a hanging device, a method for hanging an object, and an object incorporating the hanging device that can be used for mirrors or frames or other like objects.

Still further, an advantage of the present invention is to provide a hanging device, a method for hanging an object, and an object incorporating the hanging device that can be used on objects of varying sizes and weights.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

The present invention generally relates to a device and a method for hanging an object, such as a mirror or frame or other like objects. The present invention further relates to an object for incorporating such a hanging device.

Figure 1:
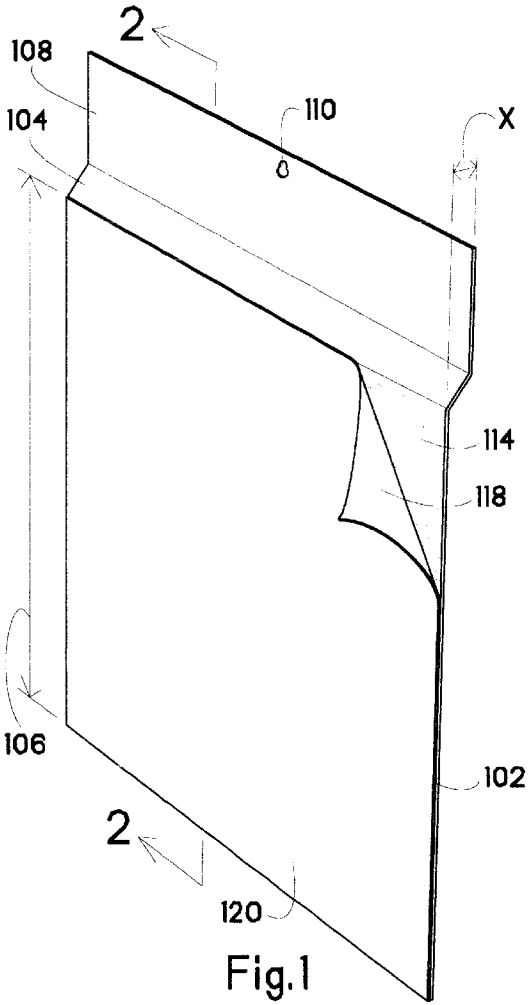
FIG. 1 illustrates a perspective view of an embodiment of a bracket of the present invention.

Referring now to the drawings wherein like numerals refer to like parts, FIG. 1 generally illustrates a perspective view of a bracket 100. The bracket 100 is preferably constructed from, for example, a metal sheet 102. The metal sheet 102 may have a bend 104 such that a substantial portion 106 of the metal sheet 102 is flat, and the bend 104 forms a link between the substantial portion 106 and a hanging portion 108. Accordingly, a depth "X" may be formed by the bend 104 between the substantial portion 106 and the hanging portion 108. The substantial portion 106, the bend 104 and the hanging portion 108 are preferably integrally formed. Preferably, a plane including the substantial portion 106 may be substantially parallel to a plane including the hanging portion 108 and separated by the depth "X". A hole 110 may preferably be centered in the hanging portion 108 of the metal sheet 102.

Figure 2B:
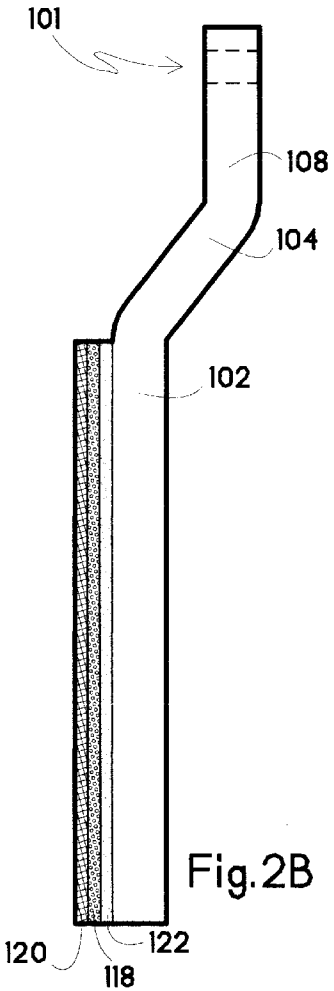
FIGS. 2*b* illustrates a cross-sectional view of an alternate embodiment of a bracket of the present invention.
Figure 2A:
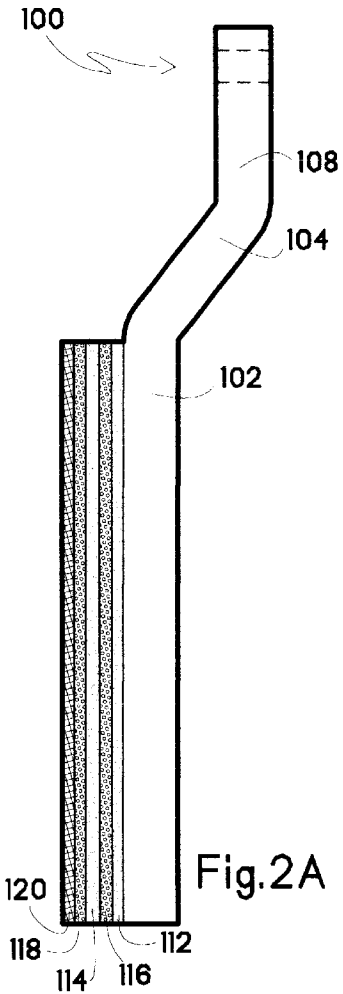
FIGS. 2*a* illustrates a cross-sectional view of an embodiment of a bracket of the present invention taken generally along line II—II of FIG. 1.

Referring now to FIG. 2*a,* a cross-sectional view of the bracket 100 is illustrated taken generally along lines II—II of FIG. 1. The bend 104, the substantial portion 106 and the hanging portion 108 of the metal sheet 102 are shown. A first adhesive layer 112 is attached to the substantial portion 106 of the metal sheet 102. A layer 116 attaches a second adhesive layer 114 to the first adhesive layer 112. The first adhesive layer 112, the layer 116 and the second adhesive layer 114 are high strength and are generally known to those skilled in the art. A silicone/release layer 118 may be provided over the second adhesive layer 114. A non-adhesive layer 120 may be provided over the silicone/release layer 118. In a preferred embodiment, the non-adhesive layer 120 and the silicone/release layer 118 may be removed from the bracket 100 leaving the combination of the first adhesive layer 112, the layer 116 and the second adhesive layer 114. The second adhesive layer 114 is exposed, and the bracket 100 may then be attached to an object for hanging. In a preferred embodiment, the bracket 100 may be designed for use with all types of mirrors and may also be used with frames or other objects to be hung.

In another embodiment, as shown in FIG. 2*b,* another bracket 101 may be constructed with a single adhesive layer 122. A silicone/release layer 118 and a non-adhesive layer may be attached to the substantial portion 106 of the metal sheet 102. The non-adhesive layer 120 and the silicone/release layer 118 may be removed from the bracket 101 leaving the single adhesive layer 122. The single adhesive layer 122 is exposed and the bracket 101 may then be attached to an object for hanging.

Figure 3:
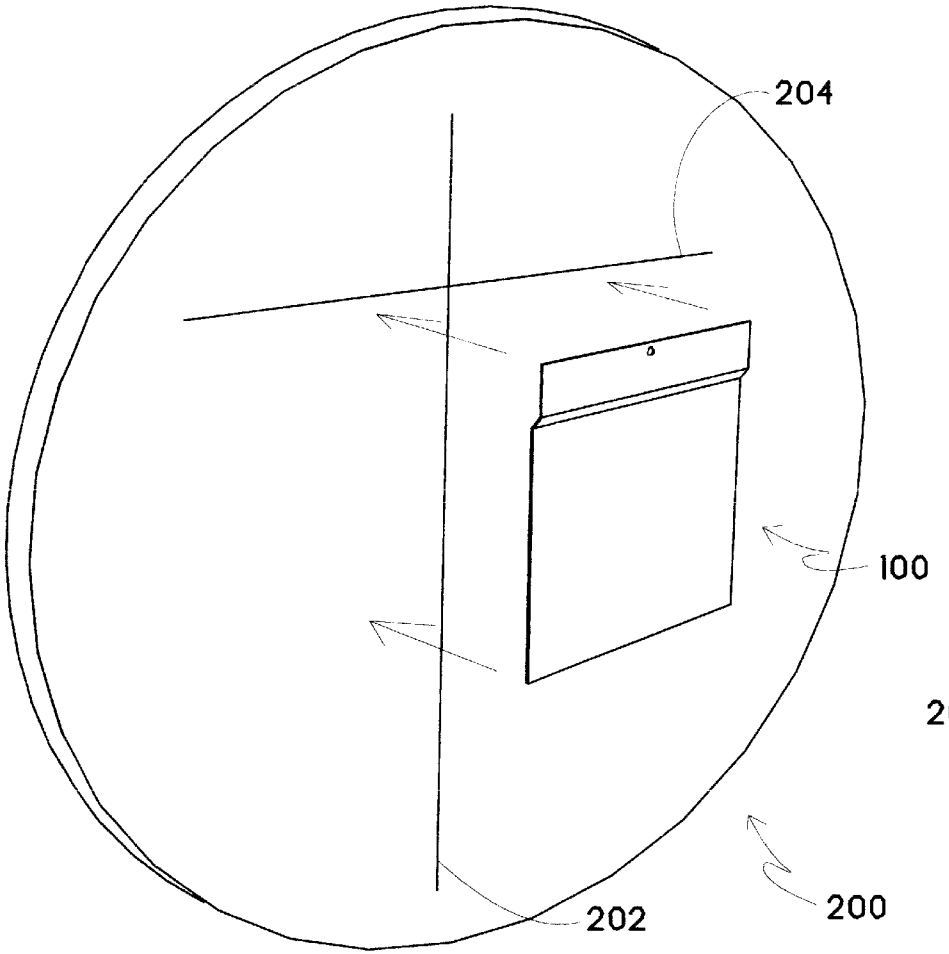
FIG. 3 illustrates perspective view of an embodiment of a bracket of the present invention being attached to an object.

Referring now to FIG. 3, to use the bracket 100, in an embodiment of the present invention, the bracket 100 may be attached to the mirror and/or object 200 to be hung. Attachment of the bracket 100 to the mirror and/or object 200 is accomplished by removing the non-adhesive layer 120 and the silicone/release layer 118 from the bracket 100 to expose the second adhesive layer 114 (as shown in FIG. 1). The bracket 100 may then be pressed against the mirror and/or object 200. In the preferred embodiment, after attaching the bracket 100 to the mirror and/or object 200 to be hung, the second adhesive layer 114 may require curing for at least two hours before hanging the mirror and/or object 200. In the preferred embodiment, the adhesive layer 114 may gain strength in time and fully cure in seven days.

Preferably, contaminants may be cleaned from the back of the mirror and/or object 200 to be hung prior to attaching the bracket 100. The area at which to attach the bracket 100 may then be identified. In an embodiment, the vertical center of the mirror and/or object 200 may be the preferred area to attach the hanging object. The vertical center of the mirror and/or object 200 may be located by, for example, drawing a vertical line 202 from the top to the bottom of the mirror and/or object 200. A mark 204 may then be made at a defined distance from the top of the mirror and/or object 200 on the vertical line 202. The mark 204 may define the preferred location for the top of the bracket 100.

In a preferred embodiment, the center of the bracket 100 may be located and marked. In a preferred embodiment, the hole 110 may be centered at the top of the bracket 100. The protective, non-adhesive layer 120 and the silicone/release layer 118 of the metal sheet 102 may then be removed (as shown in FIG. 1). Then, the mark 204 on the mirror and/or object 200 may be aligned with the bracket 100. The bracket 100 may then be pressed in place by verifying that the bracket 100 is making contact with the back of the mirror and/or object 200. Because of the design of the bracket 100 and the arrangement of the first adhesive 112 and the second adhesive 114 resulting in a distribution of weight bearing support, the bracket 100 may support objects weighing several hundred pounds. In a preferred embodiment, the substantial portion 106 supports a majority of the weight of the object to be hung. The force from the weight of the object is preferably equally distributed on the substantial portion 106. This unique configuration and design allow the bracket 100 to support a substantial amount of weight.

Figure 4:
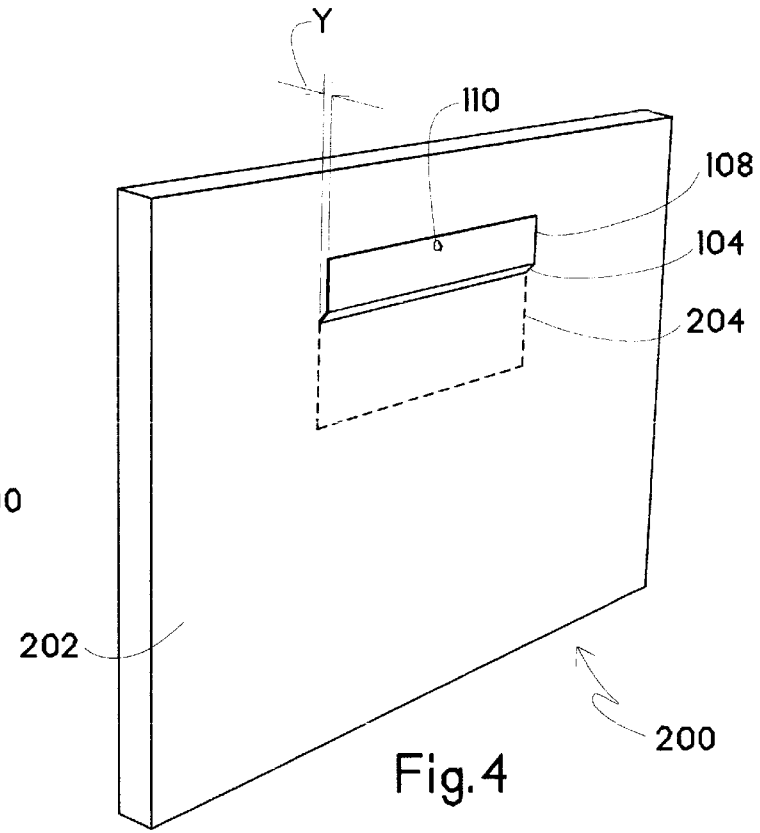
FIG. 4 illustrates a perspective view of an embodiment of a bracket of the present invention integrally constructed with an object to be hung.

Referring now to FIG. 4, in an embodiment, the mirror and/or object 200 may be constructed with the bracket 100 as an integral part of the mirror and/or object 200. Here, the bend 104 may form a link between the backside 202 of the mirror and/or object 200 and the hanging portion 108. Accordingly, a depth "Y" may be formed by the bend 104 between the backside 202 of the mirror and/or object 200 and the hanging portion 108. The mirror and/or object 200, the bend 104 and the hanging portion 108 are preferably integrally formed with the backside 202 of the mirror and/or object 200 substantially parallel to the hanging portion 108. A hole 110 is preferably centered in the hanging portion 108. Alternatively, the bracket 100 (as shown in FIGS. 1, 2*a* and 2*b*) may be manufactured separately but attached to the mirror and/or object 200 (as shown in FIG. 3) prior to, for example, the sale of the mirror and/or object 200. The mirror and/or object 200 with the bracket 100 pre-attached is shown by the hidden lines 204 in FIG. 4.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

I claim:

1. An apparatus for hanging an object, the apparatus comprising:

a sheet having a first portion and a second portion wherein the first portion forms a majority of the sheet and is integrally connected to the second portion;

a bend connecting the first portion of the sheet to the second portion of the sheet wherein the first portion of the sheet is in a plane offset from the second portion of the sheet;

a hole in the second portion of the sheet;

a first adhesive having a first side and a second side wherein the first side is substantially covers the first portion of the sheet;

a layer having a front side and a back side wherein the front side is attached to the second side of the first adhesive;

a second adhesive attached to the back side of the layer; and a non-adhesive layer and a silicone layer removably attached to the second adhesive such that the silicone layer is located between the non-adhesive layer and the second adhesive.

2. The apparatus of claim 1 wherein the sheet is constructed of metal.

3. The apparatus of claim 1 wherein the hole is shaped to fit around a protruding element.

4. The apparatus of claim 1 wherein the sheet is rectangular in shape.

5. The apparatus of claim 1 wherein the first portion has a substantially greater width and height than the second portion.

6. The apparatus of claim 1 wherein the first adhesive has a substantially similar width and height as the first portion.

7. The apparatus of claim 1 wherein the first adhesive, the layer and the second adhesive have substantially similar dimensions.

8. A method for hanging an object, the method comprising the steps of:

providing a sheet having a first portion defined by a first plane between a first end and a second end and a second portion defined by a second plane having a first end and a second end wherein the first plane and the second plane are substantially parallel;

providing a bend connecting the first end of the first portion of the sheet to the first end of the second portion of the sheet wherein the first plane is vertically and horizontally offset from the second plane without overlap of the first plane with the second plane and further wherein the first end of the first portion is connected to the bend, and the first end of the second portion of the sheet is connected to the bend wherein the bend vertically and horizontally separates the first plane from the second plane;

providing an adhesive on the first portion; and attaching the first portion to the object.

9. The method of claim 8 further comprising the steps of:

locating a center of the object;

locating a center of the sheet;

aligning the center of the sheet with the center of the object; and attaching the center of the sheet at the center of the object.

10. The method of claim 8 further comprising the step of:

curing the adhesive on the first portion for a definite period of time.

11. The apparatus of claim 8 wherein the first portion has a substantially greater width and height than the second portion.

12. The apparatus of claim 8 wherein the adhesive has substantially similar width and height as the first portion.

13. An apparatus mountable to a surface, the apparatus comprising:

a back side defining a first plane;

a bend protruding from the back side; and a hanging device associated with the bend wherein the hanging device is in a second plane offset a depth from the first plane of the back side wherein the first plane is vertically and horizontally offset from the second plane without the first plane overlapping the second plane.

14. The apparatus of claim 13 wherein the hanging device is substantially parallel to the back side.

15. The apparatus of claim 13 further comprising:

a hole in the hanging device.

16. The apparatus of claim 13 wherein the hanging device is rectangular in shape.

17. The apparatus of claim 13 wherein the back side has substantially greater width and height than the hanging device and the bend.

* * * * *